US008468670B2

(12) United States Patent
Baigorri Hermoso

(10) Patent No.: US 8,468,670 B2
(45) Date of Patent: Jun. 25, 2013

(54) ENHANCED AUTOMATIC RIVETING SYSTEM

(75) Inventor: Julián Baigorri Hermoso, Pamplona (ES)

(73) Assignee: Loxin 2002, S.L., Pamplona (ES)

( * ) Notice: Subject to any disclaimer, the term of this patent is extended or adjusted under 35 U.S.C. 154(b) by 1229 days.

(21) Appl. No.: 11/596,240

(22) PCT Filed: May 13, 2005

(86) PCT No.: PCT/ES2005/000262

§ 371 (c)(1),
(2), (4) Date: Aug. 14, 2008

(87) PCT Pub. No.: WO2005/110643

PCT Pub. Date: Nov. 24, 2005

(65) Prior Publication Data

US 2009/0007410 A1 Jan. 8, 2009

(51) Int. Cl.
*B23P 11/00* (2006.01)
*B21J 15/02* (2006.01)

(52) U.S. Cl.
USPC ..... 29/243.53; 29/34 B; 29/50; 29/54; 29/798; 29/525.06; 29/432

(58) Field of Classification Search
USPC ..... 29/243.53, 798, 525.06, 432, 50, 29/52, 53, 54, 55, 34 B, 33 K, 33 R
See application file for complete search history.

(56) References Cited

U.S. PATENT DOCUMENTS

| | | | | | |
|---|---|---|---|---|---|
| 3,010,597 | A | * | 11/1961 | Beasley et al. | 227/56 |
| 3,543,985 | A | * | 12/1970 | Adolphi | 227/7 |
| 4,620,657 | A | * | 11/1986 | Gladding et al. | 227/147 |
| 4,688,711 | A | * | 8/1987 | Gladding et al. | 227/147 |
| 4,732,525 | A | | 3/1988 | Neumann | |
| 4,785,528 | A | | 11/1988 | Soderberg | |
| 4,852,418 | A | | 8/1989 | Armstrong | |
| 4,919,321 | A | * | 4/1990 | Rydstrom et al. | 227/69 |
| 4,955,119 | A | * | 9/1990 | Bonomi et al. | 29/50 |
| 5,123,158 | A | * | 6/1992 | Dixon | 29/714 |
| 5,331,732 | A | * | 7/1994 | Kvalheim | 29/787 |
| 5,427,297 | A | * | 6/1995 | Tymianski | 227/109 |

(Continued)

FOREIGN PATENT DOCUMENTS

| | | | |
|---|---|---|---|
| DE | 2505667 | A * | 8/1976 |
| DE | 3400679 | A1 | 7/1985 |

(Continued)

OTHER PUBLICATIONS http://www.exechonworld.com/document/200804/article22.htm.

(Continued)

*Primary Examiner* — Essama Omgba
(74) *Attorney, Agent, or Firm* — McDonnell Boehnen Hulbert & Berghoff LLP

(57) ABSTRACT

An enhanced automatic riveting system of the type used in robotized precision facilities to perform multiple functions, such as boring, reaming, rivet insertion, riveting, cleaning, etc. at a single work point, using the same equipment, characterized by the fact that it uses a multi-tool head, which does not move itself but is fixed on a parallel kinematic machine, which carries out all the combined positioning movements of the multi-tool head, performing the relevant position corrections between the different physical locations of the separate tools placed in the tool-holder head.

7 Claims, 2 Drawing Sheets

U.S. PATENT DOCUMENTS

| | | | | |
|---|---|---|---|---|
| 5,477,597 | A * | 12/1995 | Catania et al. | 29/34 B |
| 5,486,174 | A | 1/1996 | Fournet-Fayard et al. | |
| 5,524,808 | A * | 6/1996 | Vogrig | 227/147 |
| 5,609,444 | A * | 3/1997 | Valsecchi | 408/79 |
| 5,823,906 | A | 10/1998 | Ashburn et al. | |
| 5,865,063 | A | 2/1999 | Sheldon | |
| 5,964,664 | A | 10/1999 | Cook et al. | |
| 5,987,726 | A | 11/1999 | Akeel | |
| 6,014,909 | A | 1/2000 | Fiora | |
| 6,035,733 | A | 3/2000 | Yoshizawa | |
| 6,099,217 | A | 8/2000 | Wiegand et al. | |
| 6,131,272 | A * | 10/2000 | Girouard, Sr. et al. | 29/714 |
| 6,189,418 | B1 * | 2/2001 | Sloan et al. | 81/57.36 |
| 6,219,898 | B1 * | 4/2001 | Kubanek et al. | 29/525.06 |
| 6,266,871 | B1 * | 7/2001 | Edwards | 29/818 |
| 6,295,710 | B1 * | 10/2001 | Roberts et al. | 29/407.01 |
| 6,405,421 | B1 * | 6/2002 | Tang | 29/243.53 |
| 6,427,312 | B1 * | 8/2002 | Kubanek et al. | 29/525.06 |
| 6,658,962 | B1 | 12/2003 | Rosheim | |
| 6,719,506 | B2 | 4/2004 | Chang et al. | |
| 6,729,202 | B2 | 5/2004 | Gosselin et al. | |
| 6,949,056 | B2 * | 9/2005 | Soroka et al. | 483/14 |
| 7,076,866 | B2 * | 7/2006 | Iannucci | 29/809 |
| 7,357,049 | B2 * | 4/2008 | Hermoso | 74/490.09 |
| 7,402,009 | B2 * | 7/2008 | Hamann et al. | 409/212 |
| 7,490,401 | B2 * | 2/2009 | Mossbeck et al. | 29/798 |
| 7,516,533 | B2 * | 4/2009 | Mossbeck et al. | 29/432 |
| 2002/0173226 | A1 | 11/2002 | Carlson | |
| 2003/0121351 | A1 | 7/2003 | Gosselin et al. | |
| 2003/0232579 | A1 | 12/2003 | Carlson | |
| 2004/0089695 | A1 * | 5/2004 | Svensson | 227/99 |
| 2004/0194569 | A1 * | 10/2004 | Hermoso | 74/490.01 |
| 2006/0241810 | A1 * | 10/2006 | Zhang et al. | 700/245 |
| 2007/0137476 | A1 * | 6/2007 | Neumann | 91/506 |
| 2009/0320271 | A1 * | 12/2009 | Perez Marin et al. | 29/524.1 |
| 2010/0254778 | A1 * | 10/2010 | Whinnem et al. | 408/1 R |
| 2010/0307278 | A1 * | 12/2010 | Mignano | 74/490.03 |

FOREIGN PATENT DOCUMENTS

| | | | |
|---|---|---|---|
| DE | 19904702 | A1 | 8/2000 |
| EP | 0292056 | A1 | 11/1988 |
| EP | 571336 | A1 * | 11/1993 |
| GB | 252499 | A | 6/1926 |
| JP | 03285736 | | 12/1991 |
| JP | 2003159682 | | 6/2003 |
| WO | 02094505 | A1 | 11/2002 |

OTHER PUBLICATIONS

F. Majou, P. Wenger, and D. Chablat, The Design of Parallel Kinematic Machine Tools Using Kinetostatic Performance Criteria, http://arxiv.org/ftp/arxiv/papers/0705/0705.1038.pdf.

A. Wavering, "Parallel Kinematic Machine Research at NIST: Past, Present, and Future" First European-American Forum on Parallel Kinematic Machines Theoretical Aspects and Industrial Requirements Aug. 31-Sep. 1, 1998 http://www.isd.mel.nist.gov/documents/wavering/PKM_Final.pdf.

* cited by examiner

ENHANCED AUTOMATIC RIVETING SYSTEM

BACKGROUND OF THE INVENTION

As its title indicates, the present descriptive report refers to an enhanced automatic riveting system of the type used in robotised precision facilities to perform, with the same equipment and at the same work point, multiple functions such as boring, reaming, rivet insertion, riveting, cleaning, etc., characterised by the fact that it uses a multi-tool head that does not itself move, fixed on a parallel kinematic machine that carries out all the combined positioning movements of the multi-tool head, performing the appropriate position corrections between the different physical locations of the separate tools placed in the tool-holder head.

Automatic riveting systems are currently widely known. Some of these systems are based on the use of an anthropomorphic robot, that is a robot with an arm equipped with several spin axes that is permanently anchored to the floor or the work surface. These robots are usually fitted with rotating multi-tool heads, also known as "end effectors", of the revolver-type due to the fact that they use a rotary system similar to a revolver, driven by a rotation motor with the appropriate control and positioning mechanisms. These heads comprise a fixed part attached to the end of the working arm of the anthropomorphic robot and a multiple tool-holder mechanism that moves in rotation with respect to the fixed part referred to above. In this case the process used involves the anthropomorphic robot positioning one of the tools at the work point and leaving it there to carry out the different localised riveting tasks, exchanging tools by means of the characteristic rotation movement of the rotating multi-tool head, so that each operation is carried out at the same point and with the appropriate tool. In this system, the anthropomorphic robot movement is only used to transport the rotating multi-tool head to the work point; it does not move subsequently during the riveting process itself, which is totally carried out by the rotating multi-tool head.

Examples of this type of rotating multi-tool heads are described, for example, in US patents 20020173226 "Multi-spindle end effector", US 20030232579 "Multi-spindle end effector", WO02094505 "Multi-spindle end effector" and EP0292056 "Driving mechanism and manipulator comprising such a driving mechanism", all of which apply to the same riveting system and have similar working characteristics.

The major disadvantage of this riveting system is that it requires the multi-tool head to be built with sufficient precision to ensure correct repetitive positioning of the different tools at the riveting point, as the anthropomorphic robot does not have this repetitive positioning precision. This means that the rotating multi-tool head and its internal mechanical rotating and positioning components must be of the highest precision and made with very high-cost, low-wear materials, which means that these heads are very expensive—in most cases more so than the anthropomorphic robot itself that supports and transports the head—and they also require frequent maintenance and adjustment work. It is also noteworthy the additional problem of frequent breakdowns that are very expensive to repair.

To solve the problems that arise with current systems that are capable of carrying out multiple operations with a single equipment, we have devised the enhanced automatic riveting system that is the subject of this invention, which uses several separate single-function heads fixed individually to the work flange of the parallel kinematic machine. This set of single-function heads comprises a common base equipped with a plurality of housings of appropriate shape, preferably cylindrical, intended to house each of the different single-function heads (drilling head, sealant applicator, rivet inserter, riveter, etc.).

The parallel kinematic machine used as a support robot, due to its intrinsic ability to carry out movements on multiples axes simultaneously with extremely high precision in terms of positioning and repeatability, is in charge of moving the set of single-function heads to the work point in the same way as conventional robots do, but it also subsequently carries out the relevant movements of the single-function heads so that, during the different riveting phases, each of the tools or actuators held on the different individual heads can act at the same work point with the required precision. These movements of the parallel kinematic machine correspond to the correction that this machine's numeric control must carry out to compensate for the displacement or offset between the different tools or actuators on the different single-function heads. In this way, during the riveting process, the parallel kinematic machine itself will position the tools or actuators at the riveting point.

This enhanced automatic riveting system is particularly suitable for all precision operations that involve consecutive positioning of several tools or actuators at the same point, such as boring and riveting, in which boring, suction of chippings, rivet insertion, riveting or sealant application tools and artificial 3D vision or operation quality check systems, etc. may be required to operate sequentially at the same point, all of them being positioned separately on the same support flange, which acts as a mechanical interface with the parallel kinematic machine.

This set of single-function heads can have different layouts for the cylindrical housings, although linear arrangements in a single row of housings or matrix arrangements are preferable.

Each of the housings for each single-function head will be equipped with a linear movement mechanism, enabling the tool or actuator to protrude slightly from its housing during use, bringing it nearer the surface of the part to be riveted and withdrawing it inside the housing when no longer in use. In this way it is avoided that a single-function head that is not in use may collide accidentally with the surface or body to be riveted. This linear movement mechanism will be similar to any of the commonly used electric, pneumatic or hydraulic types and will be controlled by the numeric control on the parallel kinematic machine that supports it.

The enhanced automatic riveting system that is being presented has many advantages over currently available systems, the most important of which is the fact that it obviates the need for complex actuator or tool positioning and feeding mechanisms, thereby obtaining an appreciable reduction in the cost of said element as well as increasing its reliability, precision and mechanical duration.

A further significant advantage lies in the fact that, because the system movement is provided exclusively by a parallel kinematic machine, positioning and repeatability precision are extrapolated to the entire process and to all the tools and actuators.

Another advantage of this invention is the easy and economical way in which the riveting system adapts to any number of tools and actuators, due mainly to the characteristic simplicity of the set of separate single-function heads.

An added benefit is that this system can be adapted very easily to any kind of parallel kinetic machine, enabling its work functions to be extended with no need for heavy additional financial outlay.

BRIEF SUMMARY OF THE INVENTION

The invention comprises an enhanced automatic riveting system of the type used in robotised precision facilities to perform multiple functions, such as boring, reaming, rivet insertion, riveting, cleaning, etc. at a single work point, using the same equipment, characterised by the fact that it uses a multi-tool head, which does not move itself but is fixed on a parallel kinematic machine, which carries out all the combined positioning movements of the multi-tool head, performing the relevant position corrections between the different physical locations of the separate tools placed in the tool-holder head.

The main advantage of the invention presented is that it obviates the need for complex tool-holder head-changing mechanisms to carry out different bore diameters or other operations, thereby achieving an appreciable reduction in the cost of said element as well as increasing its reliability, precision and mechanical duration.

BRIEF DESCRIPTION OF THE DRAWINGS

An example of the present invention will now be described in detail with reference to the accompanying drawings, in which.

DETAILED DESCRIPTION OF THE INVENTION

Figure 1:
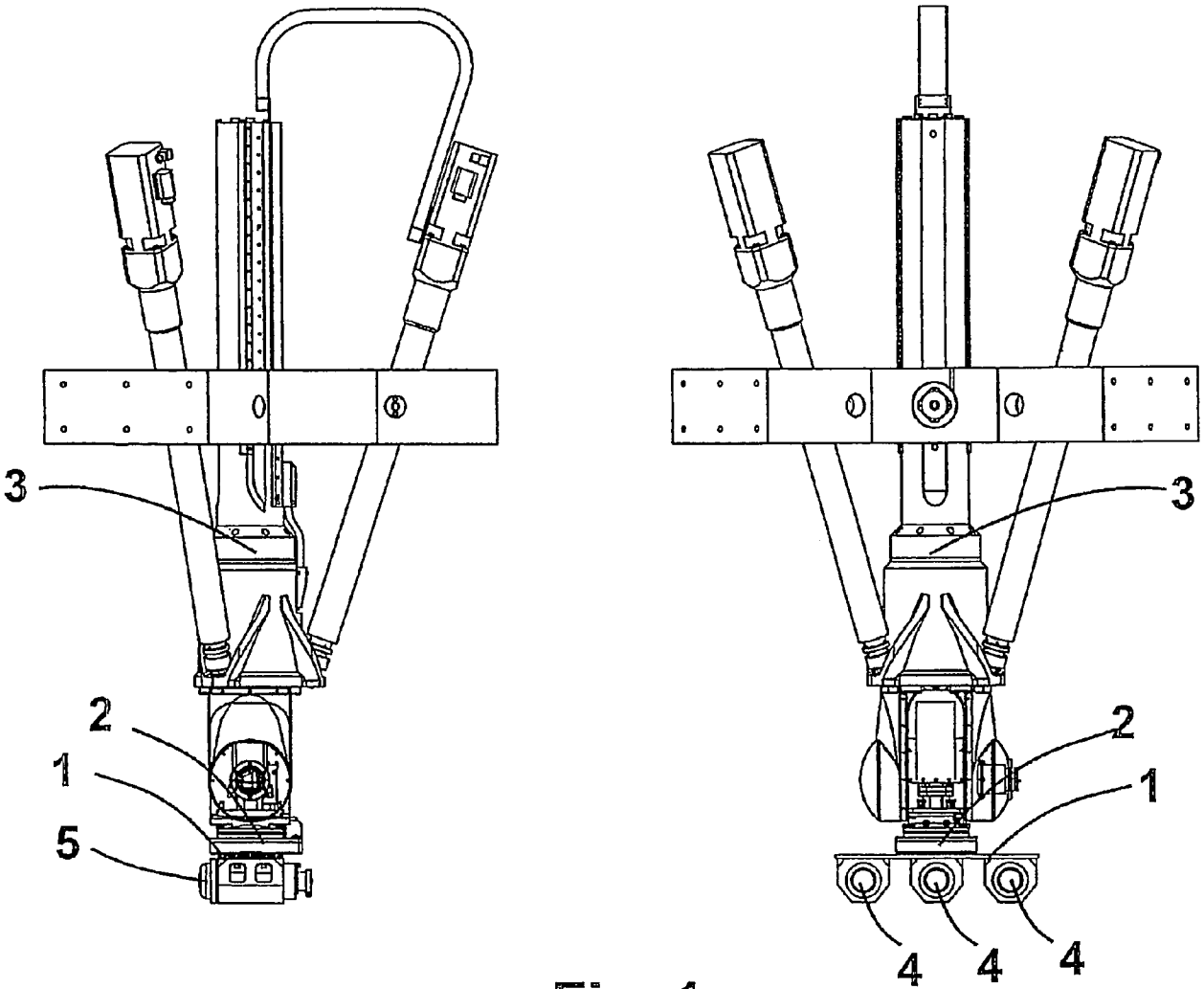
FIG. 1 presents a front and side view of the unit, comprising a parallel kinematic machine and an example of a set of single-function heads positioned separately, in this case equipped with housing for three single-function heads.
Figure 2:
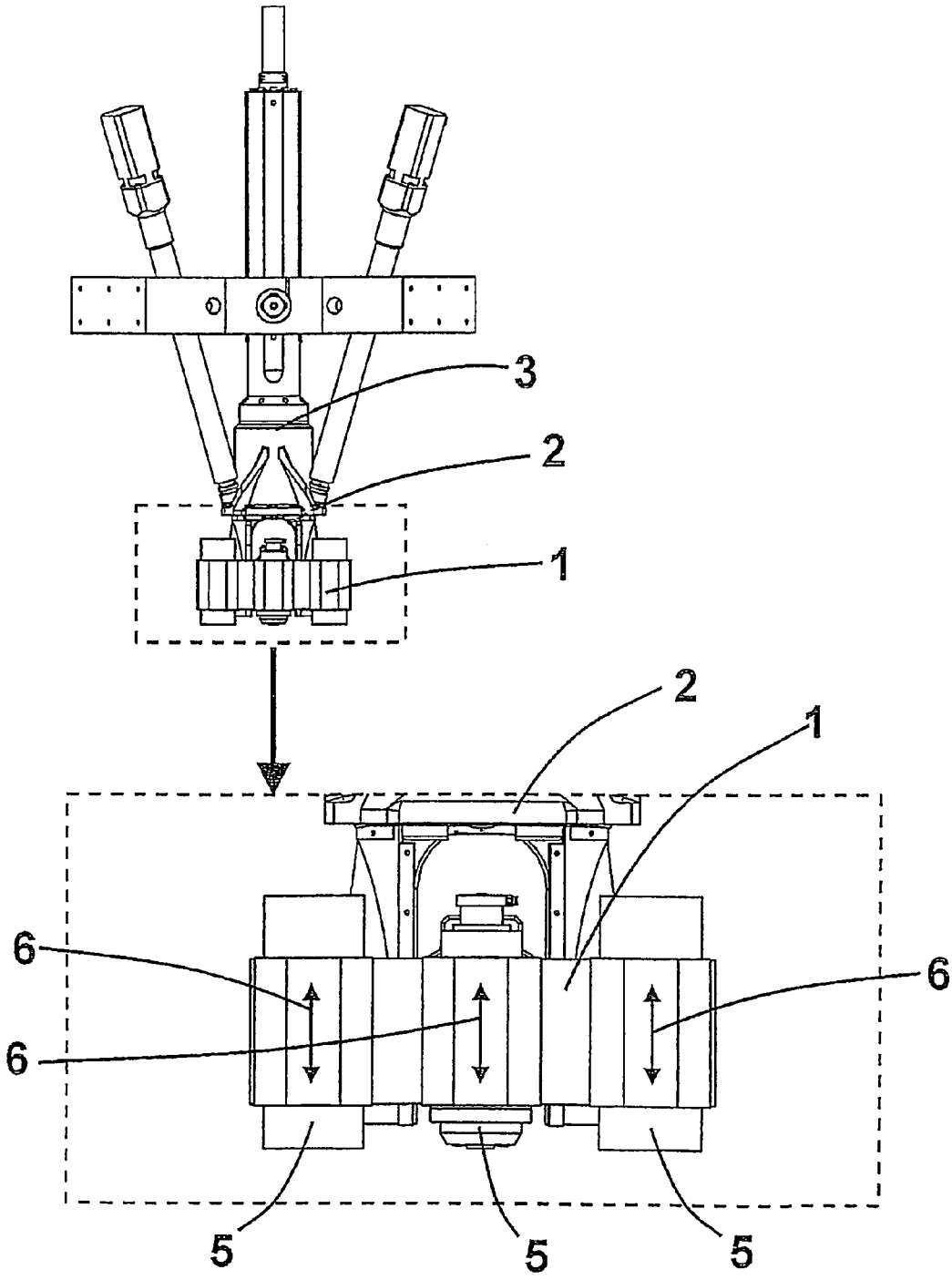
FIG. 2 presents a view of the unit described above, showing the upper part of the set of single-function heads with an exploded diagram illustrating the possible approach movement of each of them separately.

For a better understanding of the subject of this invention, a practical preferred embodiment of an enhanced automatic riveting system is represented in the attached drawing, with an example of a set of individual single-function heads.

As can be seen from the attached drawing, the enhanced automatic riveting system that is the subject of the present invention uses a set (1) of single-function heads (5) fixed solidly to the flange (2), which acts as a mechanical interface with the parallel kinematic machine. This set (1) of single-function heads (5) comprises a common base equipped with a plurality of housings (4), preferably cylindrical, each of which is designed to house a different type of single-function head (5) to carry out a specific function or to use a work tool.

The parallel kinematic machine (3) is used as a support robot thanks to its intrinsic ability to carry out movements on several axes simultaneously with extremely high positioning and repeatability precision, which is responsible for moving the set (1) of single-function heads (5) to the work point and also subsequently carries out the relevant movements of the set (1) of single-function heads (5) so that each of the single-function heads (5) held in the individual housings (4) can act at a common working point with the required precision within preset tolerances during the riveting process. These movements of the set (1) of single-function heads (5) correspond to the correction that the parallel kinematic machine's (3) numeric control must perform out to compensate for the displacement or offset that separates the different single-function heads (5) included in the set (1) of single-function heads (5).

As has been explained above, each of the housings (4) for the single-function heads (5) is equipped with a linear movement mechanism (6) to avoid possible collisions with the machining surface.

We deliberately refrain from giving a detailed description of the other features of the system being presented or of the components that comprise it, as we consider that these features are not the subject of any claim.

Having described the nature of the present invention in sufficient detail, in addition to the means for putting it into practice, all that remains to be added is that its description is not restrictive, and that variations can be made both in materials, shapes and sizes, provided that said variations do not alter the essential nature of the characteristics claimed below.

The invention claimed is:

1. An enhanced automatic riveting system, of the type used in robotised precision facilities to perform multiple functions with the same equipment, comprising a set of separate single-function heads arranged substantially in parallel to each other, each holding a tool, fixed solidly by means of a mechanical interface flange to a parallel kinematic machine, wherein the parallel kinematic machine is configured to move the set of single-function heads to a working position at the same time as it carries out one or more relevant movements of the set of single-function heads, so that each of the tools held in the different single-function heads can act at a common working point during a riveting process, said movements taking place in such a way as to carry out any required correction of any displacement or offset between the single-function heads.

2. The enhanced automatic riveting system of claim 1, wherein the set of separate single-function heads comprises a common base equipped with a plurality of housings, each of which holds one of the separate single-function heads.

3. The enhanced automatic riveting system of claim 2 wherein the plurality of housings are cylindrical.

4. The enhanced automatic riveting system of claim 2, wherein each of the housings for the single-function heads of the set of single-function heads is equipped with a linear movement mechanism to avoid possible collisions with a riveting surface.

5. The enhanced automatic riveting system of claim 1 wherein each separate single-function head within the set of separate single-function heads is fixed solidly by means of the mechanical interface flange to the parallel kinematic machine.

6. An enhanced automatic riveting system, of the type used in robotised precision facilities to perform multiple functions with the same equipment, comprising (a) a set of separate single-function heads, each holding a tool, each single-function head being fixed solidly by means of a mechanical interface flange to a parallel kinematic machine, such set of separate single-function heads comprising a common base equipped with a plurality of housings, each of which holds one of the separate single-function heads, and (b) such parallel kinematic machine being configured to move the set of single-function heads to a working position at the same time as it carries out one or more relevant movements of the set of single-function heads, so that each of the tools held in the different single-function heads can act at a common working point during a riveting process, said movements taking place in such a way as to carry out any required correction of any displacement or offset between the different single-function heads.

7. The enhanced automatic riveting system of claim 6 wherein each separate single-function head within the set of separate single-function heads is arranged substantially parallel to each other.

* * * * *